US008161876B2

(12) United States Patent
Geissler et al.

(10) Patent No.: US 8,161,876 B2
(45) Date of Patent: Apr. 24, 2012

(54) REGISTER MARK TO BE DETECTED BY A REGISTER SENSOR

(75) Inventors: Wolfgang Geissler, Bad Schönborn (DE); Christopher Riegel, Bruchsal (DE); Frank Schumann, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 180 days.

(21) Appl. No.: 12/563,384

(22) Filed: Sep. 21, 2009

(65) Prior Publication Data

US 2010/0007690 A1 Jan. 14, 2010

Related U.S. Application Data

(62) Division of application No. 11/121,491, filed on May 3, 2005, now Pat. No. 7,637,210.

(30) Foreign Application Priority Data

May 3, 2004 (DE) ..... 10 2004 021 597

(51) Int. Cl.
*B41F 3/08* (2006.01)

(52) U.S. Cl. ..... 101/481; 101/183; 101/248; 358/504; 358/515

(58) Field of Classification Search ..... 101/171, 101/174, 181, 183, 248, 481, 484, 485, 486; 358/1.12, 3.26, 3.28, 1.18, 504, 505, 515, 358/518

See application file for complete search history.

(56) References Cited

U.S. PATENT DOCUMENTS 2,728,814 A * 12/1955 Berger ..... 348/743
5,247,462 A 9/1993 Blasius et al.

(Continued)

FOREIGN PATENT DOCUMENTS

DE 1030363 B 5/1958

(Continued)

OTHER PUBLICATIONS

German Search Report dated Dec. 21, 2004.

(Continued)

*Primary Examiner* — Ren Yan
(74) *Attorney, Agent, or Firm* — Laurence A. Greenberg; Werner H. Stemer; Ralph E. Locher

(57) ABSTRACT

An apparatus in a machine for processing printing material has a register sensor for register measurement between at least two color separations of a printed image printed above one another on a printing material. The register sensor registers optically deviations between the two color separations and forwards the deviations onto a computer. The register sensor contains at least one photodiode having at least two quadrants. The largely rectangular evaluation areas of the photodiode are aligned obliquely in relation to the edges of the conveyed printing material. A register mark to be detected by the register sensor has a plurality of wedge-shaped colored areas pointing in a peripheral direction of the printing material, one of the wedge-shaped colored areas being a reference color used as a reference variable and others of the wedge-shaped colored areas being register colors to be controlled. An alternative register mark has a first field for length calibration; a second field having a wedge of a reference color selected as a reference variable; and a third field containing a register color to be controlled. The may also be provided a measuring field formed as a point-symmetrical field exhibiting a color of a color separation as a full tone.

5 Claims, 5 Drawing Sheets

U.S. PATENT DOCUMENTS

| | | | |
|---|---|---|---|
| 5,249,139 | A | 9/1993 | Blasius et al. |
| 6,226,070 | B1 | 5/2001 | Yamamoto |
| 6,682,163 | B2 | 1/2004 | Metzler et al. |
| 7,170,648 | B2 | 1/2007 | Pilloud |
| 7,184,153 | B2 | 2/2007 | Leonhardt |

FOREIGN PATENT DOCUMENTS

| | | | |
|---|---|---|---|
| DE | 4014706 | A1 | 11/1991 |
| DE | 4014708 | A1 | 12/1991 |
| DE | 19738992 | A1 | 3/1999 |
| DE | 10132266 | A1 | 1/2002 |
| DE | 10131957 | A1 | 1/2003 |
| JP | 58190703 | A | 11/1983 |
| JP | 64011835 | A | 1/1989 |
| JP | 64034741 | A | 2/1989 |
| JP | 4229269 | A | 8/1992 |
| JP | 2002240247 | A | 8/2002 |
| JP | 2003025550 | A | 1/2003 |

OTHER PUBLICATIONS

English translation of Japanese Office Action dated Aug. 30, 2010.

* cited by examiner

REGISTER MARK TO BE DETECTED BY A REGISTER SENSOR

CROSS-REFERENCE TO RELATED APPLICATIONS

This is a divisional of patent application Ser. No. 11/121,491, filed May 3, 2005; the application also claims the priority, under 35 U.S.C. §119, of German patent application No. DE 10 2004 021 597.9, filed May 3, 2004; the prior applications are herewith incorporated by reference in their entirety.

BACKGROUND OF THE INVENTION

Field of the Invention

The present invention relates to an apparatus in a machine for processing printing materials. The apparatus has a register sensor for register measurement between at least two color separations of a printed image printed above one another on a printing material. The register sensor registers optically a deviation between two color separations lying one above the other on the printing material and passing the deviation onto a computer. The invention also relates to register marks to be registered by the register sensor.

In each press having a plurality of printing units, there is in principle the danger that the overprinted color separations will not be printed exactly one above another and will exhibit what are known as register deviations. Therefore, each press has at least two printing units offers the possibility of minimizing the register deviations by corrective devices. The changed register settings can in this case be entered manually into the control system of the press by an operator of the same, or an automatic control device, an automatic register adjustment device, is incorporated which, by a sensor, detects register deviations and transmits these to the control system of the press, so that the control system of the press makes appropriate changes to the settings in order to minimize the register deviation. Such an apparatus is known from published, non-prosecuted German patent application DE 101 32 266 A1.

SUMMARY OF THE INVENTION

It is accordingly an object of the invention to provide a register sensor that overcomes the above-mentioned disadvantages of the prior art devices of this general type, which permit reliable optical detection of the register deviation of all the inks involved in the print relative to one another.

With the foregoing and other objects in view there is provided, in accordance with the invention, an apparatus for a machine for processing printing materials. The apparatus contains a register sensor for register measurement between at least two color separations of a printed image printed above one another on a printing material. The register sensor registers optically deviations between the two color separations lying one above the other on the printing material and passes the deviations to a computer of the machine. The register sensor contains at least one photodiode having at least two quadrants. The photodiode further has largely rectangular evaluation areas aligned obliquely in relation to edges of the printing material to be conveyed.

The new two-quadrant photodiode shows a configuration of two light-sensitive elements, onto which a field that is to be illuminated and which is present on the printing material is projected by an optical system. Such a field is a register mark applied to the printing material. The light-sensitive elements convert the image of the illuminated field into electrical signals that, in electronics connected downstream, such as a control computer of the press or separate measurement electronics, are converted into a measured variable that is a measure of the magnitude of the register deviation. Depending on how many measuring fields there are on color separations disposed relative to one another on the printing material, a plurality of measuring passes is necessary. By use of the two-quadrant photodiode as a register sensor, reliable detection and calculation of the register deviation between at least two color separations on the printing material is thus possible.

Furthermore, provision is made for the largely rectangular evaluation areas of the two-quadrant photodiode to be aligned obliquely in relation to edges of the conveyed printing material. Since the edges of the register marks on the printing material normally do not run parallel to the edges of the printing material but are formed as oblique wedges, the detection of these oblique edges can be improved with an obliquely disposed photodiode. Although lines aligned parallel to the edges of the printing material are thereby detected more poorly, as a result of the improved detection of the oblique edges a more uniform signal overall can be achieved. For example, the photodiode can be aligned in such a way that the signal is approximately the same both in the case of oblique and in the case of parallel aligned edges of the register marks.

In a further refinement of the invention, provision is made for the register sensor to be a four-quadrant photodiode, whose measuring areas have, at least to some extent, oblique edges. Using such a four-quadrant photodiode, as opposed to parallel or obliquely aligned two-quadrant photodiodes, it is possible to detect both oblique and straight edges optimally. For this purpose, the photodiode has four measuring fields, which are divided once perpendicularly and once obliquely. Using appropriate wiring of the evaluation electronics, in this way optimal detection of parallel and also obliquely aligned register marks can be achieved.

Furthermore, provision is made for the register sensor to be a CCD image converter, whose signals are evaluated by image-processing electronics and are supplied to the computer. Instead of the photodiodes, imaging elements are used here, which output the signals to image-processing electronics. The CCD image converters thus operate as a video camera, which registers the parallel or obliquely aligned edges of the register marks, the image registered by the camera being reprocessed in the image-processing electronics by appropriate algorithms in such a way that the position of the parallel and oblique edges of the register marks can be transmitted to the computer of the machine processing printing materials. Reliable detection of register marks is also possible in this way.

In addition, a register mark to be detected by a register sensor is provided, which contains a plurality of wedge-shaped colored areas pointing in the peripheral direction of the printing material, one color being the reference color used as a reference variable and the others being the register colors to be controlled. In a register control system, in principle a reference color has to be selected, to which the other colors can be controlled in accurate register. The reference color is normally black, so that all the other colors are controlled to black. By such a register mark, which has a plurality of colored areas, it is now possible to measure a plurality of colors per printing material simultaneously with one measurement and thus to obtain quickly a complete set of color register measured values. This constitutes a considerable advantage as compared with a coarse register mark, with which in each case only one color per printing material can be measured. However, since all the colors should first have their register controlled, at least in broad or general terms, in addition to the register mark having a plurality of colored areas, there should still be a coarse register mark present. This configuration is required above all for inline measuring systems in sheet-fed presses, which measure the register deviation continuously by a register sensor, in order to be able to control out register deviations occurring during the printing process. Since the coarse register does not play any part in small register deviations occurring during continuous printing, however, by the register mark having a plurality of wedge-shaped colored areas, in continuous printing all the colors present can be advantageously registered with one measurement on a printing material and processed accordingly.

Provision is advantageously made for the register mark to contain a field for length calibration and also a field that is formed of a wedge of the reference color selected as reference variable, and a further field that contains the register color to be controlled. Such a register mark is normally designated a coarse register mark, the width of the field for length calibration being known to the measuring electronics and in this way it being possible for the register sensor to be adjusted without difficulty when scanning the field for length calibration. In addition, provision can be made for the register mark on the printing material to be measured to have a defined number of parallel lines. The parallel lines are used as a type of bar code in order to increase the information content of the register marks. By using the lines, it is possible for example to check whether this is actually a position field or not another measuring field. It is thus possible to check whether the measuring electronics are evaluating the correct measuring field.

Provision is advantageously made for the parallel lines to be configured with different widths. By use of the lines having different widths, various bar codes built up in a manner currently known are used to encode various items of information in the register mark. For example, the type of mark can be encoded, so that the registering sensors of the machine processing printing material are able to identify the marks before their actual evaluation.

Furthermore, provision is made to build up a measuring field to be registered by a register sensor in such a way that the measuring field is point-symmetrical and exhibits the color of a color separation as a full tone. Point-symmetrical shapes are extremely suitable for monitoring the correct register setting. Although it is relatively difficult to calculate adjustment recommendations from this, symmetry errors can be detected relatively easily for this by register sensors, so that these marks are extremely well suited for checking the correct setting of the register. Using such a measuring field, it is possible to achieve the measurement of the color values and of the register values by use of only one field. The measurement of the color can be carried out by a photodiode or a CCD image converter by measuring the full-tone field in the color separation.

However, it is also possible to expand the aforementioned register marks by, in addition to the colored areas for register measurement, there being a full-tone field. In this case, the symmetry of the full-tone field is not used for the register measurement but rather, by the register marks, the register deviation is determined and the color is measured by use of a full-tone field located between the register marks. As opposed to the point-symmetrical measuring fields, by use of the additional wedge-shaped register marks present here, an adjustment recommendation is easy to calculate.

In a further refinement of the invention, provision is made for there to be full-tone fields and register fields at least for two colors. Using this expanded register mark, the register deviation of two colors in relation to each other and also their full tones can be measured simultaneously. With correspondingly more full-tone fields and register fields, a plurality of colors in the full tone and in their register position in relation to one another can correspondingly be measured.

Other features which are considered as characteristic for the invention are set forth in the appended claims.

Although the invention is illustrated and described herein as embodied in a register sensor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figures 1, 1A:
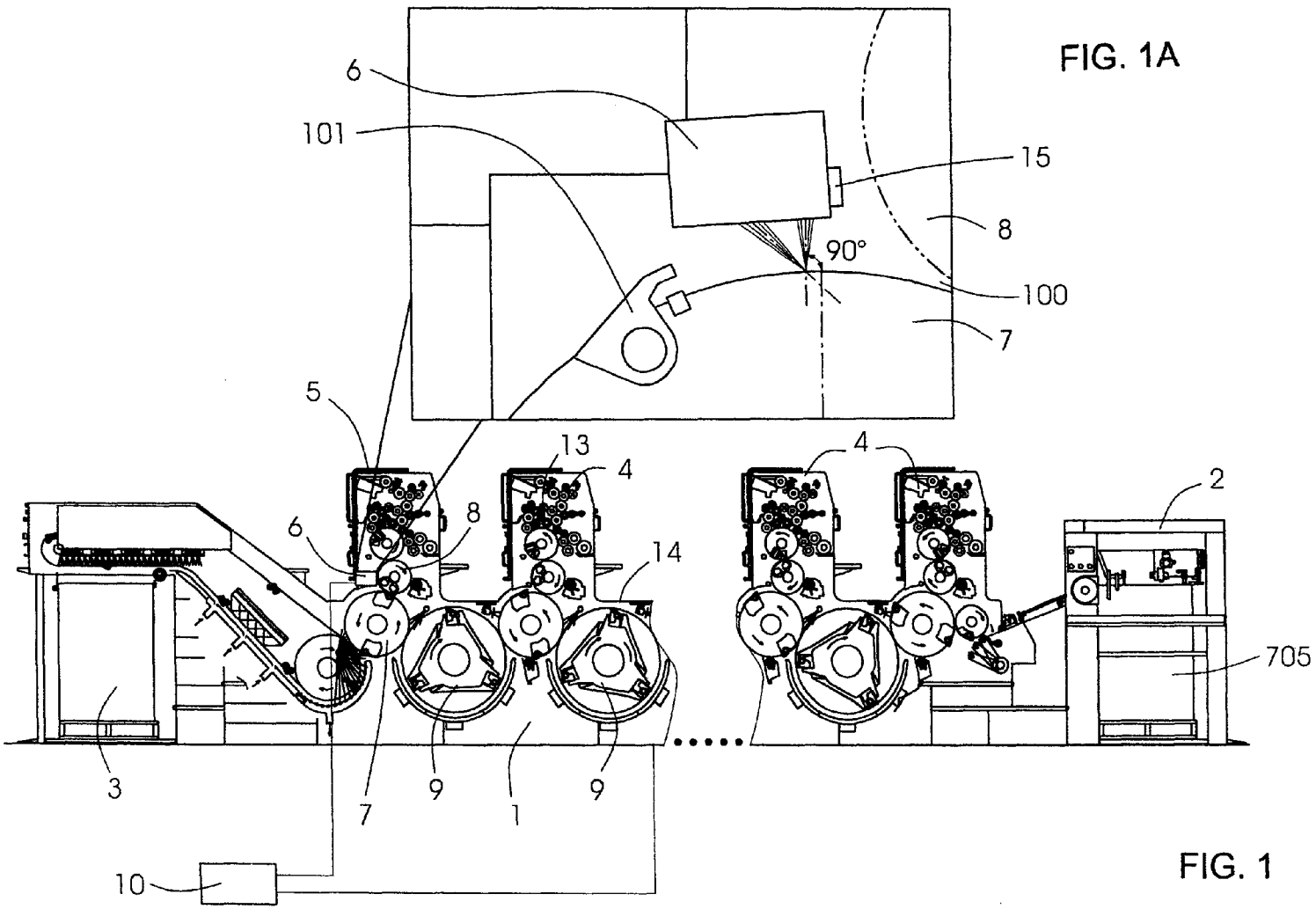
FIG. 1 is a diagrammatic, side elevational view of a press having an inline measuring apparatus and register sensors according to the invention.
FIG. 1A is an enlarged, diagrammatic, side elevational view of detail IA shown in FIG. 1.

Referring now to the figures of the drawing in detail and first, particularly, to FIG. 1 thereof, there is shown a press 1. The press 1 is a sheet-fed rotary press having a feeder module 2 for conveying printing sheets 705 from a sheet stack into the press 1, and also having a deliverer 3 at the other end of the press 1, which stacks the printed sheets 705. In between them, in FIG. 1, there are four printing units 4, 5, the last printing unit 5 in the sheet transport direction being equipped with an inline measuring apparatus. In principle, any number of printing units 4, 5 can have the inline measuring apparatus and it is not necessarily to be installed in the last printing unit 5. The inline measuring apparatus 6 is used primarily for the spectral measurement of the print control strip on the printed sheets 705 after the passage through the press 1, in order to be able to carry out automatic color control. In FIG. 1A, two register sensors 15 are fitted to the inline measuring apparatus 6, which has the form of a measuring beam, it being possible in principle for the register sensors 15 also to be integrated into the measuring beam 6. The register sensors 15 are fitted in the edge regions, so that in each case they register the longitudinal lateral edge region of the sheets 705 in the sheet running direction. If there is no inline measuring apparatus 6 in the press, the register sensors 15 are fitted above the transport path of the printed sheets 705 by a separate suspension in the printing unit 5. It is important that the register sensors 15 are fitted so close to the sheet transport path that they can detect the register marks on the printed sheets 705 without difficulty and, on the other hand, are not disposed too close, so that the printed sheets 705 do not touch the register sensors 15 and contaminate or damage them as a result. In the embodiment according to FIG. 1, however, the sensors 15 are fitted to the measuring beam 6 of the inline measuring apparatus and can be removed together with the latter, which is in turn installed in the vicinity of a press nip 100 of the last printing unit 5. This offers the advantage that, during the measurement by the inline measuring beam 6 or the register sensors 15, the printed sheet 705 is always held by the press nip 100, which is formed by a press cylinder 8 and an impression cylinder 7, and by sheet grippers 101 of the impression cylinder 7, and is thus stabilized for the measurement. The printing units 4, 5 of the press 1 each have side walls 14, in which the press cylinders 7, 8 are mounted. In addition, each of the printing units 4, 5 has an inking unit 13. In order to control the entire press 1, there is a computer 10 which, transmits setting commands to the press 1 and, monitors the press 1 in that measured values from the inline measuring apparatus 6 and the register sensors 15 are transmitted continuously to the computer 10. Thus, the register sensors 15 are incorporated in the control and regulation of the press 1, so that register deviations occurring during the printing process between individual color separations on the printed sheet 705 can be controlled out by the computer 10.

Figure 2:
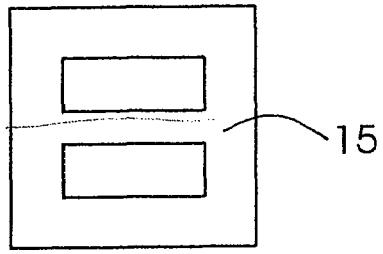
FIG. 2 is an illustration of a two-quadrant photodiode aligned parallel to a leading edge of printing material.
Figure 2A:
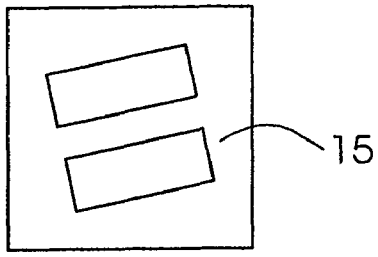
FIG. 2A is an illustration of the two-quadrant photodiode aligned obliquely with respect to the leading edge of the printing material.

A first embodiment of the register sensors 15, which are constructed as a two-quadrant photodiode, can be seen in FIG. 2. Normally, two register sensors 15 are fitted in the lateral regions of the printing unit 5, so that they can scan the edge regions of the printed sheet 705 having the register marks. The two quadrants of the photodiode of the register sensor 15 are in this case rectangular and are aligned parallel to the leading edge of the printed sheet 705 conveyed through the press 1. The two areas of the register sensor 15 are wired in such a way that the difference between the signals is fed to the computer 10. By the embodiment according to FIG. 2A, it is possible to improve the output signal from the sensor 15 for detecting oblique edges. For this purpose, a photodiode is aligned obliquely with respect to the leading edge of the printed sheet 705, in order to be able to detect the oblique edges of register marks better. Even if, as a result, horizontal edges of the register marks can then be detected less well, the oblique configuration according to FIG. 2A leads to a more uniform signal, which improves the registration of the position of the register marks overall.

Figure 3:
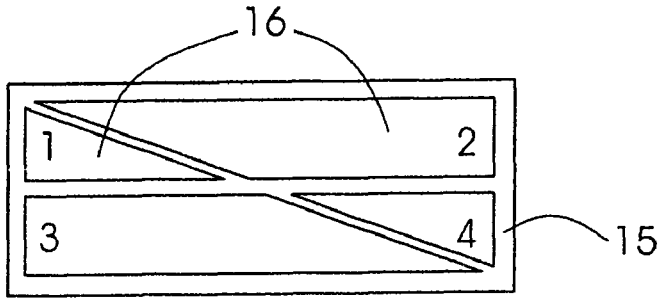
FIG. 3 is an illustration of a four-quadrant photodiode for detecting straight and oblique edges.

A further embodiment, according to FIG. 3, combines the advantages in the detection of straight and oblique edges of register marks with one another. For this purpose, the register sensor 15 has a four-quadrant photodiode, which has a straight and an oblique subdivision. By use of the beveled register sensor areas 16 it is possible to detect oblique edges extremely well, the straight subdivision meaning that straight edges can also be detected very well. To detect oblique edges, in this case the signals from the areas 16.1 and 16.3 are summed in the computer 10, as are the signals from the areas 16.2 and 16.4. To detect straight edges, on the other hand, the signals 16.1 and 16.2 are summed, as are the signals 16.3 and 16.4. The two signals resulting from the summing operations are then subtracted. The computer 10 therefore has four inputs for the four fields of the four-quadrant photodiode of the register sensor 15. The electronics for evaluating the register sensor 15 can, however, also be accommodated outside the computer 10, directly in the sensor 15 or the measuring beam 6, the electronics then still having two outputs for straight and oblique edges, whose signals are passed on to the computer 10.

Figure 4:
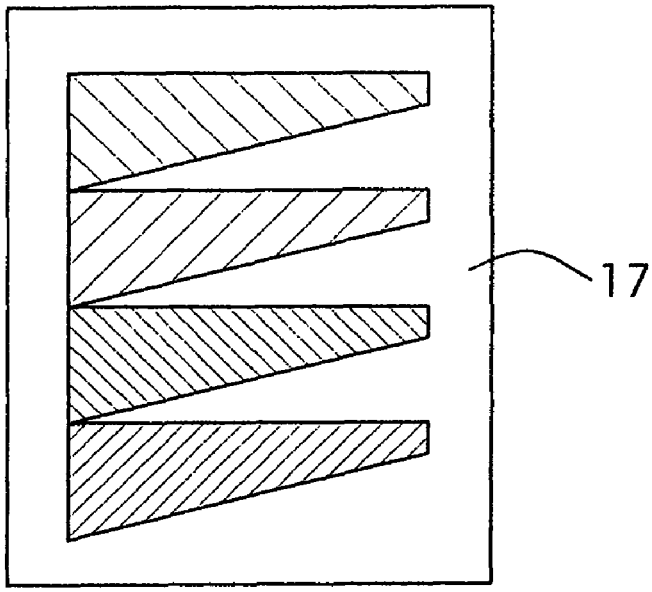
FIG. 4 is an illustration of a fine register mark having a reference color and three register colors to be controlled.

FIG. 4 depicts a register mark for fine register adjustment. The fine register mark 17 has wedge-shaped markings for four colors and in this way permits the accurate-register control of the printed images applied in the printing units 4, 5 on the printed sheet 705. One of the wedge-shaped colored markings, expediently the uppermost marking placed first in the sheet transport direction, is printed in the reference color, which is normally black. The other three wedge-shaped colored markings represent the three further colors to be controlled to the black color. The fine register mark 17 can be registered by the register sensor 15 by one measurement, so that, during the measurement over a printed sheet 705, a complete register measurement of all the colors in relation to one another is carried out. As a result, given any occurrence of register deviations, the computer 10 can intervene immediately in the settings of the press 1 in order to bring about changes as early as during the next printed sheet 705.

Figure 5:
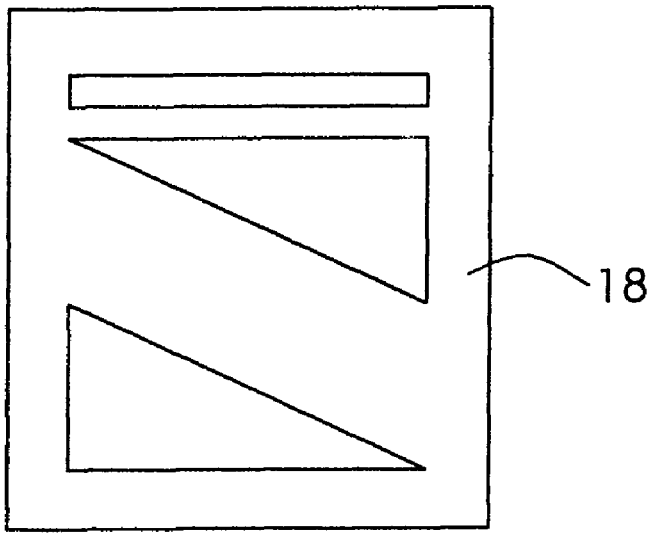
FIG. 5 is an illustration of a coarse register mark having a reference color and a control mark and also a bar for length calibration.

By contrast, FIG. 5 illustrates what is known as a coarse register mark 18, which has only two wedge-shaped markings for two colors. In this case, the upper wedge-shaped marking is the reference color, to which the color of the lower wedge-shaped marking is controlled in the event of deviations. In addition, above the reference color there is a bar-shaped marking for length calibration, which has a fixedly defined width of, for example, 4 mm. By use of the marking for length calibration, the register sensor 15 is readjusted or checked if the latter signals a length other than the 4 mm stored in the computer 10. As opposed to the fine register mark 17, the coarse register mark 18 permits only the control of one color to a reference color, so that a complete set of register measured values has to be transmitted, only over a plurality of printed sheets 705.

Figure 6:
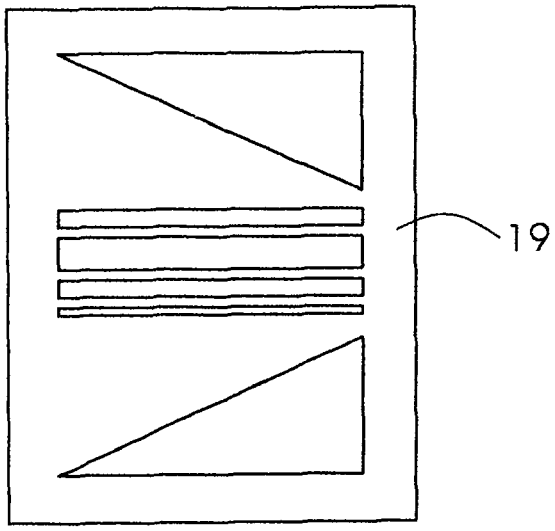
FIG. 6 is an illustration of a register mark having bar code encoding.

FIG. 6 shows the depiction of a locally coded detection mark, whose constituent parts are all printed in the reference color. The detection mark contains two wedge-shaped markings and a specific number of lines. The lines can be configured with different widths, the wedges are used for determining the lateral and peripheral position. By use of the lines, a check is made as to whether this is actually a position field. The locally coded detection mark 19 therefore leads the register marks on the sheet, as seen in the sheet transport direction, and thus signals in good time to the register sensor 15 that a register mark 17, 18 follows at a predefined, programmed distance. By use of the lines of different widths, however, other information can also be encoded in a bar code and read by the register sensor 15. Furthermore, additional information such as the number and order of the colors, position and order of the fields in the control strip, standard density of the printed colors, zonal area coverage, etc., can be deposited in encoded form here, is read out at the start of the printing process and is then available for the further course of the printing process.

Figure 7:
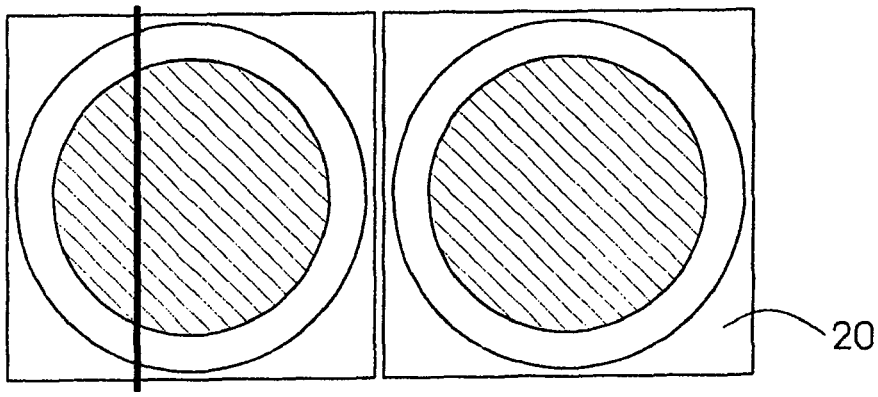
FIG. 7 is an illustration of a point-symmetrical measuring field having a full-tone field.

In order to control register deviations between different colors, point-symmetrical measuring fields such as the full-tone fields 20 in FIG. 7 can also be used. These symmetrical fields can easily be detected by the register sensor 15 and are therefore extremely well suited to checking the correct setting of the register. In addition, with a combined color measuring and register sensor, the color values and the register values can be determined in one field, namely the point-symmetrical full-tone measuring field 20.

Figure 8:
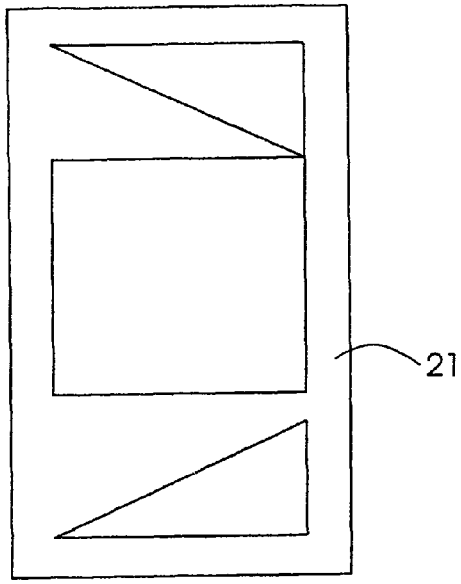
FIG. 8 is an illustration of a register mark having a reference color and having a control color and a full-tone field in the reference color.
Figure 9:
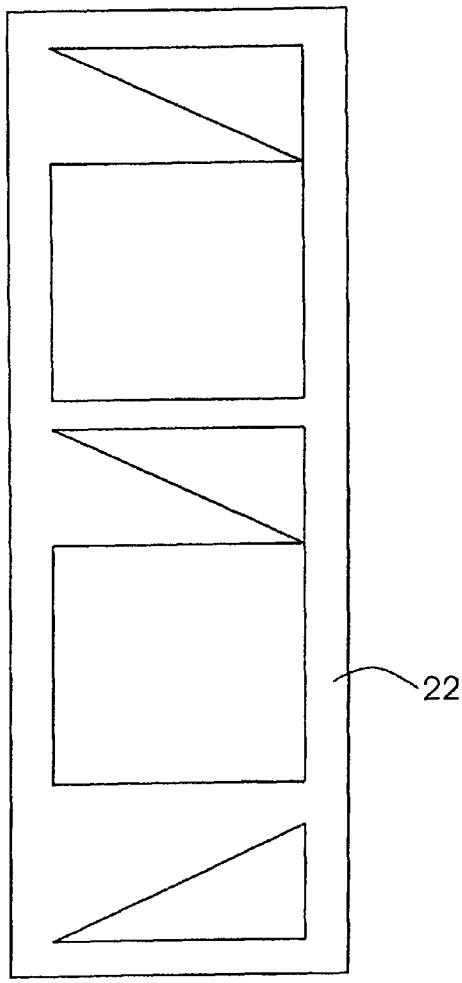
FIG. 9 is an illustration of a register mark having a reference color and a control color and also two associated full-tone fields.

A further configuration of a register mark can be seen in FIG. 8, in which a conventional register mark having a reference color of a color to be controlled is provided with an additional full-tone field of the reference color as a combined mark 21. With this, it is also possible, by use of one mark, to measure both register deviations between reference color and color to be controlled and to measure the full tone of the reference color in the large rectangular section. In an extension of the embodiment according to FIG. 8, a register mark for two colors 22 is illustrated, there being full-tone fields present both for the reference color and for the color to be controlled, so that in each case a color measurement can be carried out not only for the reference color but also for the color to be controlled, in addition to the register deviation. It is clear to those skilled in the art that all the register marks 17, 18, 19, 20, 21, 22 listed can in principle be present as desired with one another on the printed sheet 705, in particular in the edge region in the peripheral direction and in the lateral direction.

The fine register marks 17 are used primarily to control the printing process of the continuous printing phase, since here there are only small deviations and thus all the colors on each printed sheet 705 can be monitored. However, as soon as deviations can be detected in the fine register marks 17, the coarse register marks 18 must be measured again by the register sensors 15 in order to measure the offset between the individual colors explicitly, so that the adjusting motors can control the register in the individual printing units 4, 5 from the computer 10 in accordance with the deviations.

The invention claimed is:

1. In combination with a register sensor for register measurement between at least two color separations of a printed image printed above one another on a printing material, the register sensor being configured to optically register deviations between the two color separations and the register sensor containing at least one photodiode, a register mark to be detected by the register sensor, the register mark comprising:

a plurality of wedge-shaped colored areas pointing in a peripheral direction of the printing material, one of said wedge-shaped colored areas being a reference color used as a reference variable and others of said wedge-shaped colored areas being register colors to be controlled; and a detection mark preceding said wedge-shaped colored areas on the printing material in a printing material transport direction, said detection mark for signaling to the register sensor that said wedge-shaped colored areas follow at a predefined distance.

2. The register mark according to claim 1, wherein the register mark on the printing material to be measured has a defined number of parallel lines.

3. The register mark according to claim 2, wherein said parallel lines have different widths.

4. The register mark according to claim 1, further comprising a full-tone field.

5. The register mark according to claim 1, further comprising full-tone fields and said wedge-shaped color areas are register fields for at least for two colors.

* * * * *